US005809679A

United States Patent [19]

Arjmand

[11] Patent Number: 5,809,679

[45] Date of Patent: Sep. 22, 1998

[54] ILLUMINATED DISPLAY

[76] Inventor: Daryosh Arjmand, 2240 Buckthorn, Algonquin, Ill. 60102

[21] Appl. No.: 797,463

[22] Filed: Feb. 6, 1997

[51] Int. Cl.[6] ..... G09F 13/04

[52] U.S. Cl. ..... 40/564; 40/660; 40/661; 40/714

[58] Field of Search ..... 40/660, 661.02, 40/553, 564, 716, 310, 579, 580; 362/189–191, 806, 812

[56] References Cited

U.S. PATENT DOCUMENTS

| | | | |
|---|---|---|---|
| 738,569 | 9/1903 | Penfield | 40/580 X |
| 1,915,236 | 6/1933 | Messner et al. . | |
| 1,955,947 | 4/1934 | Clark | 362/812 X |
| 2,001,377 | 5/1935 | Candy, Jr. | 67/22 |
| 2,340,527 | 2/1944 | Guilfoil, Jr. | 240/13 |
| 2,514,558 | 7/1950 | Pinanski | 40/553 |
| 2,645,868 | 7/1953 | Ernst | 40/553 X |
| 3,077,981 | 2/1963 | Gaspard | 206/47 |
| 3,181,913 | 5/1965 | Guido et al. | 297/462 |
| 3,713,237 | 1/1973 | Thomson et al. | 40/132 D |
| 3,796,869 | 3/1974 | Stone | 362/812 X |
| 3,990,166 | 11/1976 | Nagelkirk | 40/77 |
| 4,041,629 | 8/1977 | Hopp et al. | 40/130 R |
| 5,075,830 | 12/1991 | Perez | 362/190 X |
| 5,416,674 | 5/1995 | Murai | 362/806 X |
| 5,513,084 | 4/1996 | Simpson | 362/806 X |
| 5,564,816 | 10/1996 | Arcadia et al. | 362/806 X |

FOREIGN PATENT DOCUMENTS

| | | | |
|---|---|---|---|
| 985651 | 7/1951 | France | 40/564 |
| 290856 | 5/1928 | United Kingdom | 40/553 |

*Primary Examiner*—William Stryjewski
*Attorney, Agent, or Firm*—Welsh & Katz, Ltd.

[57] ABSTRACT

An illuminated display. The illuminated display comprises a cylindrical hollow housing capable of passing illumination therethrough that has an upper end and a lower end, wherein the upper end is open and the lower end is closed, and a cylindrical wall which forms the open upper end and is also connected to the closed lower end. The housing wall has an outer surface and an inner surface. Additionally, the housing wall has at least one opening disposed between the upper end and the lower end. At least one light source is located inside the housing and is operatively connected to the opening. There is also a cap that has a top and a bottom. The cap bottom is adapted to fit inside the housing upper end. A substantially cylindrical sleeve capable of passing illumination therethrough is adapted to closely fit about the outer surface of the wall. The cap top outer surface diameter and the housing wall outer surface diameter are substantially identical to facilitate replacement of the sleeve about the housing wall outer surface and to provide for a message or design that is not distorted.

11 Claims, 1 Drawing Sheet

ILLUMINATED DISPLAY

FIELD OF THE INVENTION

The present invention relates to illuminated displays, and more particularly, to illuminated displays that duly provide for rapid and easy exchange of displayed messages or designs and provide for enhanced message and design presentation.

BACKGROUND OF THE INVENTION

Advertising and other novelty illuminated display apparatus of various types are well known in the art. Such apparatus are typically used for displaying advertising material, scenic pictures, messages, and other similar communications. These devices are commonly used in a residential or commercial setting such as a trade show, a convention, or a point of purchase location. Their main purpose is to provide an inexpensive and efficient way of communicating a selected message to a group of individuals in a relatively short amount of time.

It is well known in such illuminated displays to glue the message material directly onto the transparent wall of the display. This has the disadvantage that the removal and exchange of the message is accompanied with great difficulties. Removal of glued messages from the transparent wall can only be achieved after substantial and time consuming efforts. In addition, because the glue layer is typically irregularly distributed over the wall and the message, this is detrimental to the light transmitted and, therefore, to the image of the displayed message.

The prior art has also provided displays that have strips attached to transparent walls of the display. The strips have grooves which retain material containing the messages. The messages are placed on the walls by carefully lining up the edge of the material that the message is printed on with the groove in the strip that is attached to the wall. This procedure requires substantial time and patience because the message material tends to be difficult to line up in the small grooves. Also, after much use, the grooves get dirty and do not evenly accept the message material, thereby, causing the message material to bend and unevenly rest against the transparent wall. When the message material is bent and does not lie flat against the wall of the display, the message or design tends to be distorted and difficult to view as intended. Additionally, the strips detract from the message and tend to separate from the walls as they wear from frequent use.

Accordingly, there is a need for an illuminated display that presents a message or design without the typical requirement of additional fastening type devices or substances, thereby reducing the amount of time necessary to exchange the messages and providing for much improved viewing conditions. The present invention provides for these improvements over the prior art. The present invention eliminates the requirement of any fastening devices or additional substances to hold the message in place about the transparent wall of the illuminated display. The message is held in place due to the snugness of fit between the message material and the wall of the illuminated display. This snug fit is largely due to the precise dimensions of the various components that construct the illuminated display. Also, the message material is in the shape of a sleeve that fits snugly about the display. The combination of the precise dimensions of the sleeve and the precise dimensions of the display device provide for a message that is efficiently and quickly changed and for a message that rests against the display wall in a completely uniform fit. Also, due to the uniformity of the fit that results, the message is not distorted due to bending of the message material.

OBJECTS OF THE INVENTION

The principal object of the present invention is to provide an improved illuminated display exhibiting increased ease of exchanging message and design materials and to provide for enhanced viewability of messages and designs.

A further object of the invention is to provide an illuminated display that provides for a message or design that lies substantially flat against the illuminated display wall when the message or design material is placed on the display in order to provide enhanced message and design presentation.

A further object of this invention is to provide an illuminated display that does not require any fastening devices or additional substances to hold the message or design material in place on the display.

A further object of the invention is to provide an illuminated display which is simple in design and inexpensive to construct, and is durable and rugged in structure.

A further object of the invention is to provide an illuminated display having an attractive appearance.

Still further objects and advantages will become apparent from a consideration of the ensuing description and drawings of the invention.

SUMMARY OF THE INVENTION

These and other objects are achieved by the illuminated display of the present invention. In one form of the invention, a cylindrical hollow housing has an upper end and a lower end, wherein the upper end is open and the lower end is closed, and a cylindrical wall capable of passing illumination therethrough which forms the open upper end and is also connected, for example, integral with or affixed, to the closed lower end. The housing wall has an outer surface and an inner surface. Additionally, the housing wall has at least one opening disposed between the upper end and the lower end. At least one light source is located inside the housing and is operatively connected to the opening. There is also a cap that has a top and a bottom. The cap bottom is adapted to fit inside the housing upper end. A substantially cylindrical sleeve capable of passing illumination therethrough is adapted to closely fit about the outer surface of the wall. The cap top outer surface diameter and the housing wall outer surface diameter are substantially identical to facilitate replacement of the sleeve about the housing wall outer surface and to provide for a message or design that is not distorted.

DETAILED DESCRIPTION OF THE PREFERRED EMBODIMENT

Figure 1:
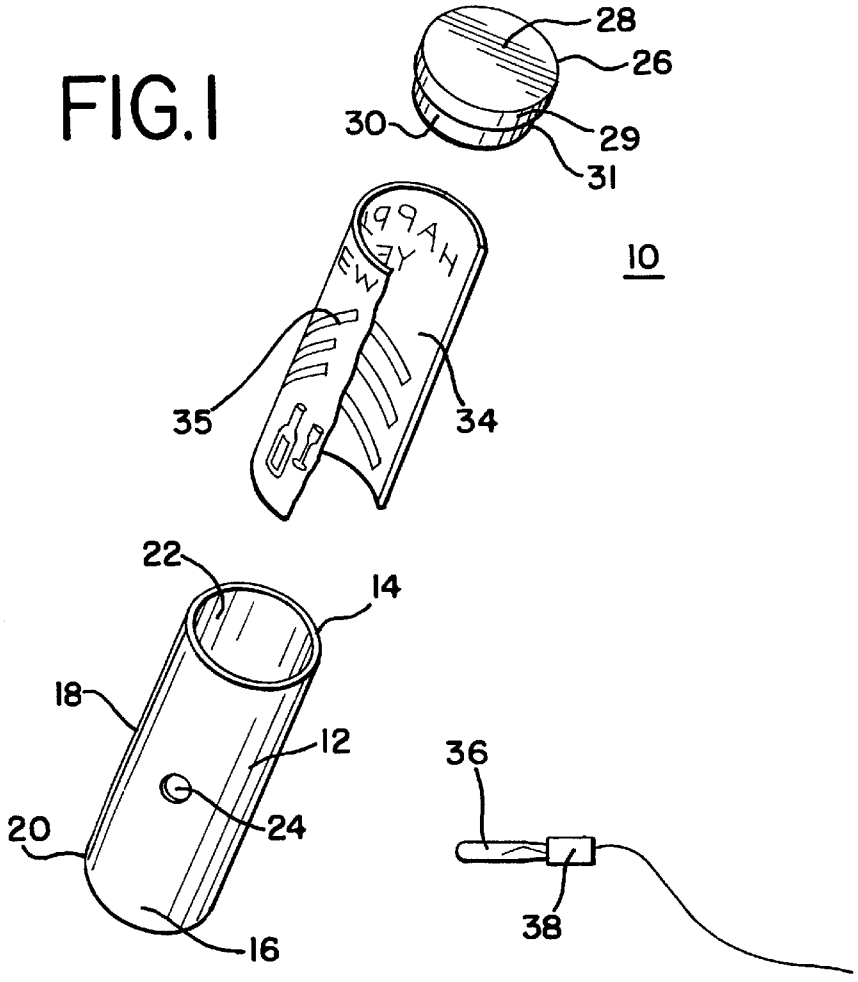
FIG. 1 is a perspective, exploded, and partly sectioned view of one embodiment of the illuminated display of the present invention.

FIG. 1 is a perspective, exploded, and partly sectioned view of one embodiment of an illuminated display 10 constructed in accordance with the present invention. In FIG. 1, the illuminated display 10 comprises a cylindrical hollow housing 12, which may be transparent or translucent, has an upper end 14 that is open and a lower end 16 that is closed. The housing 12 also has a cylindrical wall 18 that has an outer surface 20 and an inner surface 22. The cylindrical wall 18 forms the housing open upper end 14 and is connected to the housing closed lower end 16. The housing 12 is preferably constructed of a glass, a plastic, or other transparent or translucent material. The cylindrical wall 18 also contains an opening 24 disposed between the housing open upper end 14 and the housing closed lower end 16. A cap 26 has a cap top 28 that has a cap top outer surface 29 and a cap bottom 30 that has a cap bottom outer surface 31. The cap 26 is coupled to the housing upper end 14 such that the cap bottom outer surface 31 is adjacent the wall inner surface 22. Additionally, the cap 26 can be coupled to the upper end 14 in a variety of different ways, such as by a spirally wound thread, a compression fitting, or a snug fit which is created when the cap bottom outer surface 31 diameter and the housing wall inner surface 22 diameter are substantially identical. A substantially cylindrical sleeve 34 is adapted to closely fit about the wall outer surface 20. The cylindrical sleeve 34 preferably is of a relatively thin plastic, paper, or fibrous material so that it is flexible and transparent or translucent. Also, the sleeve 34 should preferably be provided with a surface texture readily adapted to accept a graphic 35 on at least a portion thereof, for example, so as to take ink so that it can be written upon. Additionally, it is desirable that the graphic 35, which can be various greeting designs and/or messages, be printed upon the cylindrical sleeve 34 in various sizes and colors. It is preferred to provide a sleeve 34 that substantially covers the cap 26 in order to provide for an aesthetically pleasing illuminated display 10. In order to illuminate the housing 12, a light source 36 is operatively connected to the opening 24 and located inside the housing 12.

Figure 2:
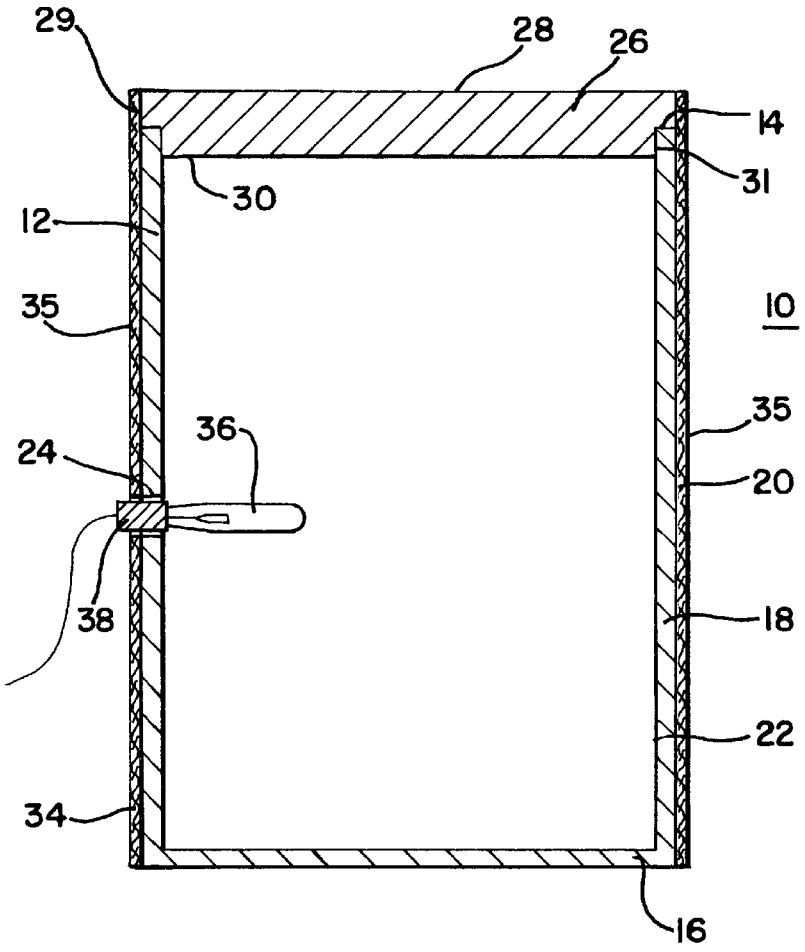
FIG. 2 is a cross-sectional view of the illuminated display of FIG. 1.

FIG. 2 is a cross-sectional view of the illuminated display of FIG. 1. In FIG. 2, the cylindrical sleeve 34 is shown in place around the housing 12 as it would be positioned during normal operation of the illuminated display 10. In order to increase the ease of changing the sleeve 34 on the illuminated display 10, the cap top 28 is constructed such that the cap top outer surface 29 diameter and the housing wall outer surface 20 diameter are substantially identical. This construction allows for the cap top outer surface 29 and the housing wall outer surface 20 to be substantially flush when the cap 28 is in place on the housing upper end 14. Additionally, the light source 36 is mounted in the opening 24 so that the light source 36 is positioned inside the housing 12 in order to provide uniform lighting for the illuminated display 10. The light source base 38 also helps to hold the sleeve 34 in position on the housing 12. Since the sleeve 34 fits snugly and uniformly against the housing wall 18 and snugly against the cap top outer surface 29, and the light source base 38 also provides for additional securing of the sleeve 34 to the housing 12, the sleeve 34 does not require any additional fastening devices or additional substances to hold the sleeve 34 in place on the housing 12.

In addition, since the cap top outer surface 29 diameter and the housing wall outer surface 20 diameter are substantially identical, the sleeve 34 lies substantially flat against the housing wall outer surface 20 when the sleeve 34 is in place around the housing 12 in order to provide enhanced message and design presentation. If the sleeve 34 does not lie substantially flat against the housing wall outer surface 20, the sleeve 34 will not be uniformly illuminated by the light source 36 and, as a result, the graphic 35, e.g. message printed on the sleeve 34 will be distorted and difficult to read.

In operation, additional weight, such as sand, rocks, or metal can be placed in the housing lower end 16 to maintain its stability if it is placed in a high traffic area. The cap 26 is then placed on the housing upper end 14. Once the cap 26 is firmly in place, the sleeve 34 is then easily placed around the housing wall outer surface 20. An opening is then punched in the sleeve 34 in the location where the sleeve 34 lies over the opening 24 in the housing wall 18. The light source 36 is then placed through the opening 24 and inside the hollow housing 12. The display 10 is then placed on a supporting surface in a desired area and the light source 36 is activated. The light from the light source 36 illuminates the graphic 35 through the transparent cylindrical sleeve 34. The display 10 is now ready for viewing. Depending on the user, a variety of messages and designs can be placed on the display 10. The designs vary according to the type of presentation required, for example, the display 10 can be used for showing different holiday themes, for advertising, for personal use in a home, and for use at trade shows. The number of uses for the illuminated display 10 are only limited by the user's imagination.

An additional embodiment of the illuminated display 10 can have more than one opening 24 in the housing wall 18. Also, more than one light source 36 would then be placed in the corresponding openings 24 and would illuminate the display 10. The number of openings 24 and light sources 36 are dictated by the size of the illuminated display 10 and the intensity of the light source 36. A larger display 10 would contain more openings 24 and light sources 36 than would a substantially smaller display 10. A larger display 10 would require more light sources 36 to provide for even illumination of the display 10.

Although in the foregoing detailed description, the present invention has been described by reference to various embodiments, it will be understood that modifications in the structure and arrangement of those embodiments other than those specifically set forth herein may be achieved by those skilled in the art and that such modifications are to be considered as being within the overall scope of the present invention.

I claim:

1. An illuminated display comprising:

a cylindrical hollow housing capable of passing illumination therethrough having an upper end and a lower end, wherein the upper end is open and the lower end is closed, and a cylindrical wall that forms the upper end and is connected to the closed lower end;

the housing wall having an outer surface and an inner surface, wherein the wall outer surface has a diameter;

the housing wall defining at least one opening disposed between the upper end and the lower end;

a substantially cylindrical sleeve capable of passing illumination therethrough adapted to fit snugly and uniformly about the outer surface of the housing wall;

the sleeve having a continuous cylindrical wall extending substantially from the lower end to the upper end of the housing, the sleeve wall defining at least one opening disposed between the upper end and the lower end of the sleeve; and at least one light source operatively connected to the at least one opening defined in said sleeve wall and to the at least one opening defined in said housing wall, said light source located within the housing, whereby illumination from said light source may pass through said housing wall and said sleeve.

2. The illuminated display of claim 1 wherein the at least one light source comprises at least one light bulb, at least one electrical light bulb socket, at least one electrical cord and each of said at least one electrical cord operatively attached to at least one socket.

3. The illuminated display of claim 2 further comprising a cap wherein the cap is coupled to the housing open upper end by spirally wound threads.

4. The illuminated display of claim 2 further comprising a cap wherein the cap is coupled to the housing open upper end by a compression fitting.

5. The illuminated display of claim 2 further comprising a cap having a top and a bottom, the cap is coupled to the housing open upper end by the cap bottom outer surface diameter and the housing wall inner surface diameter being substantially identical so that when the cap is placed on the housing open upper end, the cap bottom fits snugly in the housing upper end opening.

6. The illuminated display of claim 2 wherein the housing is constructed of a plastic.

7. The illuminated display of claim 2 wherein the housing is constructed of a glass.

8. The illuminated display of claim 2 wherein the sleeve is constructed of a plastic.

9. The illuminated display of claim 2 wherein the sleeve is constructed of a paper.

10. The illuminated display of claim 2 wherein the sleeve is constructed of a fibrous material.

11. A sleeve for a cylindrical display hollow housing, the housing having a cylindrical wall capable of passing illumination therethrough, the housing having a closed lower end and an open upper end and the display hollow housing wall having at least one opening into which at least one light source is operatively connected and located within the housing, said sleeve comprising:

a substantially cylindrical wall capable of passing illumination therethrough and having an outer surface and an inner surface dimensioned so as to fit snugly and uniformly about the outer cylindrical surface of the display hollow housing, the sleeve having a continuous cylindrical wall dimensioned so as to extend substantially from the lower end to the upper end of the housing and said sleeve wall defining at least one opening disposed between the upper end and the lower end of the sleeve, and said outer surface of said sleeve having on at least a portion thereof a graphic which is illuminated through said sleeve wall by the at least one light source when said sleeve is mounted on the display hollow housing and the at least one light source is mounted to the display hollow housing wall and operatively connected therewith.

* * * * *